US007124562B2

(12) United States Patent
Blocker

(10) Patent No.: US 7,124,562 B2
(45) Date of Patent: Oct. 24, 2006

(54) HORSE-CONTROL DEVICE

(75) Inventor: Teddie L. Blocker, Estacada, OR (US)

(73) Assignee: Toklat Originals, Inc., Lake Oswego, OR (US)

( * ) Notice: Subject to any disclaimer, the term of this patent is extended or adjusted under 35 U.S.C. 154(b) by 0 days.

(21) Appl. No.: 10/783,400

(22) Filed: Feb. 19, 2004

(65) Prior Publication Data

US 2005/0217220 A1 Oct. 6, 2005

(51) Int. Cl.
*B68B 1/04* (2006.01)
*B68B 1/02* (2006.01)

(52) U.S. Cl. ..... 54/6.1; 54/24

(58) Field of Classification Search ..... 54/6.1, 54/6.2, 7, 24; 119/792, 831, 856; 2/311; D30/136, 135; D2/627
See application file for complete search history.

(56) References Cited

U.S. PATENT DOCUMENTS

| | | | | | |
|---|---|---|---|---|---|
| 526,706 | A | * | 10/1894 | Hartwig | 54/12 |
| 544,777 | A | * | 8/1895 | Spohr | 54/7 |
| 2,932,930 | A | * | 4/1960 | Ray | 54/24 |
| 3,171,409 | A | * | 3/1965 | Cetrone | 2/311 |
| 3,273,311 | A | * | 9/1966 | Henry | 54/24 |
| 3,306,005 | A | * | 2/1967 | Stafford | 54/6.1 |
| 3,817,218 | A | * | 6/1974 | Bongiovanni | 119/856 |
| 3,949,538 | A | | 4/1976 | Woodruff | |
| 4,472,925 | A | | 9/1984 | Woodruff | |
| 4,565,055 | A | * | 1/1986 | Simpson | 54/24 |
| 4,589,248 | A | * | 5/1986 | Ruddock et al. | 54/24 |
| 4,722,171 | A | | 2/1988 | Meroth | |
| 4,999,980 | A | | 3/1991 | McGowan | |
| 5,174,097 | A | * | 12/1992 | Muratore | 54/6.1 |
| 5,660,031 | A | | 8/1997 | Clark | |
| 5,762,030 | A | | 6/1998 | Paglericcio et al. | |
| 5,794,420 | A | | 8/1998 | Fine | |
| 6,062,005 | A | | 5/2000 | Roberts | |
| 6,199,353 | B1 | | 3/2001 | Chladek et al. | |
| 6,305,152 | B1 | | 10/2001 | Myler et al. | |
| 6,371,056 | B1 | * | 4/2002 | Phillips | 119/769 |
| 6,591,589 | B1 | | 7/2003 | Cook | |
| 6,595,156 | B1 | | 7/2003 | Curran | |
| 6,643,999 | B1 | * | 11/2003 | Wheat | 54/6.1 |
| 2004/0065061 | A1 | * | 4/2004 | Rodgers | 54/6.1 |

OTHER PUBLICATIONS

Dually Halter http://www.goodwoods.com.au/prod1023.htm.*
Dually Halter, www.horseinfo.com/cart/halter.html, 1999-2005.*

(Continued)

*Primary Examiner*—Teri Pham Luu
*Assistant Examiner*—Elizabeth Shaw
(74) *Attorney, Agent, or Firm*—Klarquist Sparkman, LLP

(57) ABSTRACT

A horse-control device that allows a handler or rider to control the pressure exerted on the horse's nose and/or poll area is described. In one embodiment, the horse-control device comprises a halter that is worn on the horse's head. The halter includes a first, resilient nose band and second nose band that cooperate to regulate pressure applied to the horse's nose. When tension is applied to a lead line of the halter, the first nose band expands across the horse's nose and the second nose band applies concentrated pressure to the horse's nose. Upon removing tension from the lead line, the first nose band immediately contracts and causes the second nose band to immediately remove the pressure from the horse's nose. Also described is a strap component for a horse-control device that comprises a cable embedded within a flexible outer sheath.

27 Claims, 3 Drawing Sheets

OTHER PUBLICATIONS

Dually Halter, www.robinsons-uk.com/product_images/zoom/5804-01.jpg, 2004.*
Website, "The Be-Nice Halter and How to Use It," 2 pages, Oct. 15, 2003.
Website, "The Monty Roberts Tack," 1 page, Oct. 15, 2003.
Website, "Pet Vet Supply.com Outfitters and Wellness," 2 pages, Nov. 3, 2003.

* cited by examiner

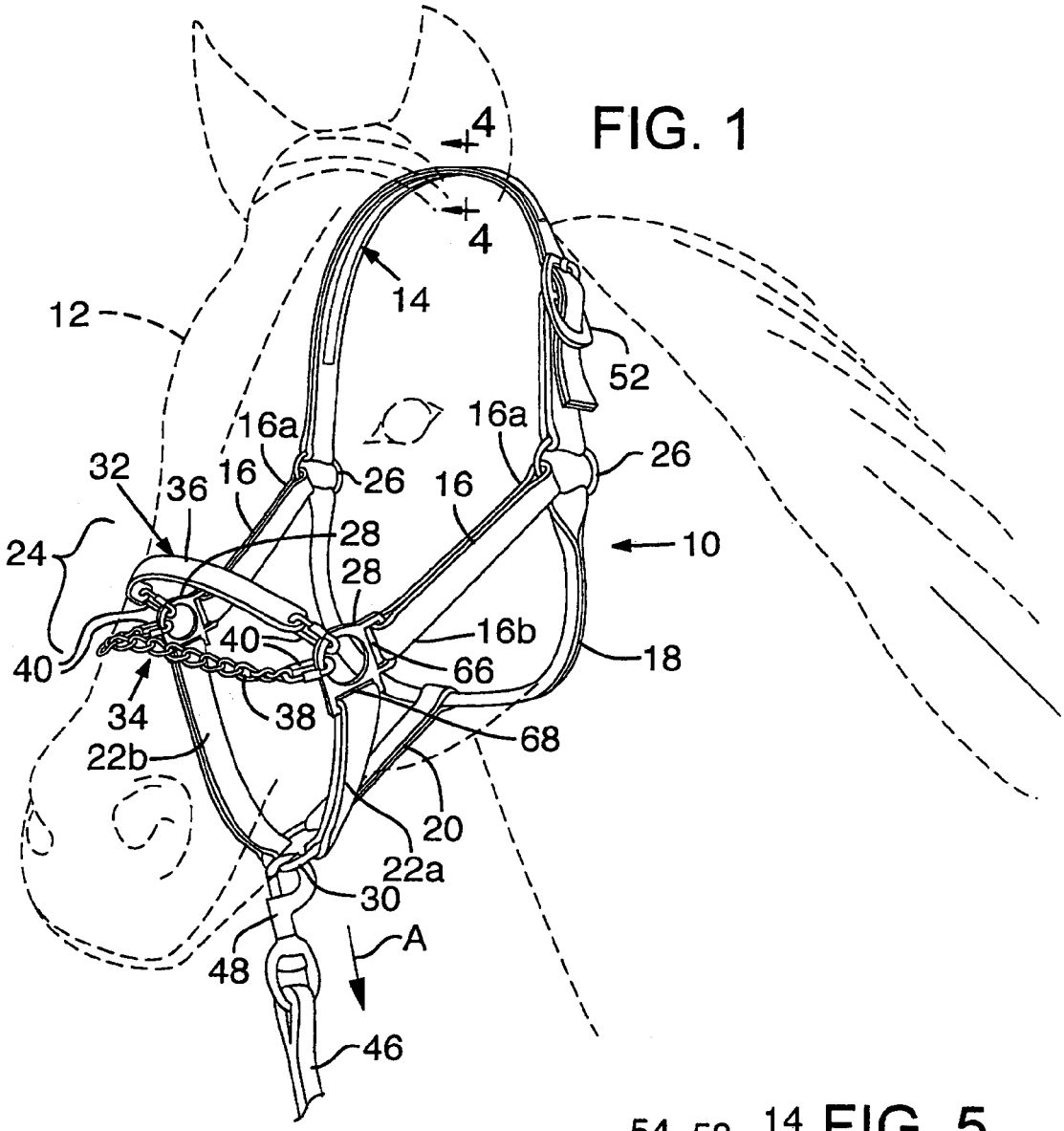
FIG. 1
FIG. 4
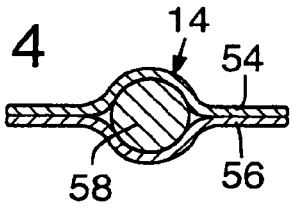
FIG. 5
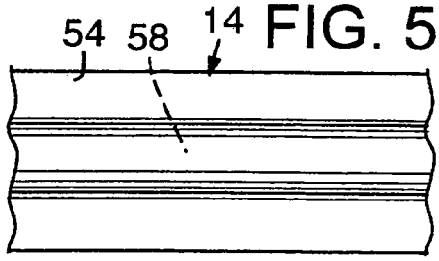

HORSE-CONTROL DEVICE

FIELD

This disclosure relates generally to devices and methods for controlling horses, such as halters and bridal bits.

BACKGROUND

Managing a horse involves communication between the horse and the human handler or rider. A variety of devices exist for achieving this communication, such as halters and bridle bits. These devices generally work by transferring some motion made by the handler or rider into some form of physical contact with the horse's body. Most horse-control devices are worn over a horse's head, partly because certain parts of a horse's head are particularly sensitive to contact.

Bridle bits incorporate a mouthpiece that fits inside the horse's mouth. The inside of the mouth is perhaps the most sensitive part of a horse, so bridle bits typically allow for maximum control. Typically, less control is needed when a horse is being led by a handler on foot, as opposed to a mounted rider. In this situation, halters may be used. Most halters include a portion that encircles the horse's mouth and another portion that extends around the horse's poll. These portions are then connected to a lead line that can be manipulated by the handler.

Horses can learn to obey commands communicated by the handler or rider. This learning process takes time and can be hindered or facilitated by the manner in which the handler or rider communicates with the horse. Horses have a tendency to resist heavy steady pressure and generally respond more favorably to light intermittent pressure. For example, if a handler or rider is signaling the horse to come to a halt by applying heavy pressure, the horse may ignore the command or try to resist.

Some existing horse-control devices incorporate a nose band that extends over the horse's nose. A nose band applies pressure to the horse's nose when the handler or rider is communicating a command. In a conventional halter, the nose band typically comprises a rope or a piece of flat nylon web that is connected at opposite ends to respective cheek pieces, such as by means of metal hardware on nylon web halters or knots on rope halters. A lead line connected to the halter allows a handler to apply a downward force to the horse's nose through the nose band.

In nylon web halters, it is known to use a chain that is connected at one end to a cheek piece, and extended over the horse's nose through an opposing check piece to the lead line. The chain applies an especially strong pressure when the handler pulls on the lead line, and therefore allows the handler to send a stronger signal to the horse. Unfortunately, the chain has a tendency to bind up and can fail to release pressure when the handler releases the pressure on the lead line and the horse complies with the command. When the chain fails to disengage, the horse receives no "positive feedback" after complying with the command. Consequently, the horse may struggle to understand how to comply and training is adversely affected.

Another pressure point useful for communicating with a horse is the poll area, located just behind the horse's ears. Many existing horse-control devices include a rope or band that presses against the poll area. While this area is sensitive, sometimes the amount of pressure exerted by the handler or rider is insufficient to affect the horse. When rope is used, knots are sometimes incorporated to focus the pressure on the poll area. Although this technique is effective, rope is susceptible to fraying. Further, available non-rope straps fail to provide a means for applying concentrated pressure to the horse's poll area.

SUMMARY

The present disclosure concerns a number of embodiments of a horse-control device and methods for its use.

According to one aspect, a horse-control device is adapted to be worn on a horse's head. Such embodiments of a horse-control device include first and second nose bands that extend over the horse's nose. The first nose band may be a relient member, such as an elastic material that expands across the horse's nose upon application of tension. The second nose band may be formed such that it exhibits little or no elasticity and fits more loosely on the horse's nose than the first nose band.

In these embodiments, the first and second nose bands cooperate to regulate pressure on the horse's nose. More specifically, when a rider or handler applies tension to the horse-control device, the first nose band expands and the slack is removed from the second nose band, causing the second nose band to tighten and apply pressure to the horse's nose. The pressure applied by the second nose band signals the horse to comply. When the rider or handler releases tension on the horse-control device, the first nose band immediately contracts and causes the second nose band to remove the pressure from the horse's nose. The immediate removal of pressure represents positive feedback and helps to condition the horse to comply with commands.

The embodiments having such first and second nose bands can be implemented in various types of horse-control devices. In one embodiment, for example, such nose bands are implemented in a halter used primarily for leading a horse. In another embodiment, such nose bands are implemented in a bridle bit or a hackamore.

According to another aspect, embodiments of the horse-control device include one or more strap components that are constructed of a cable embedded within a flexible outer sheath. The outer sheath may be constructed of first and second straps (e.g., nylon fabric straps) that are stitched or otherwise secured to each other with the cable positioned between the straps. The cable may aid in concentrating the pressure exerted by the strap component on the horse's body. In one embodiment, for example, the horse-control device comprises a halter having a poll strap that extends around a horse's poll. The poll strap comprises a flexible outer sheath and an embedded cable that applies concentrated pressure on the horse's poll upon application of tension to the halter.

In other embodiments, a horse-control device for use on a horse's head includes a resilient biasing member that extends over the horse's nose and a substantially non-resilient nose band that also extends over the horse's nose. Whenever tension is applied to the biasing member to cause the biasing member to stretch across the horse's nose, the nose band is caused to engage and apply pressure to the horse's nose. Whenever tension on the biasing member is removed, the biasing member contracts, thereby causing the nose band to reduce the pressure applied to the horse's nose.

BRIEF DESCRIPTION OF THE DRAWINGS

FIG. 1 is a perspective view of a halter, according to one embodiment, as it appears mounted on a horse's head.

FIG. 4 is an enlarged, cross-sectional view of an embodiment of a pole strap of a halter taken along line 3—3 in FIG. 1.

FIG. 5 is an enlarged, plan view of a section of the pole strap shown in FIG. 1.

DETAILED DESCRIPTION

Figure 2:
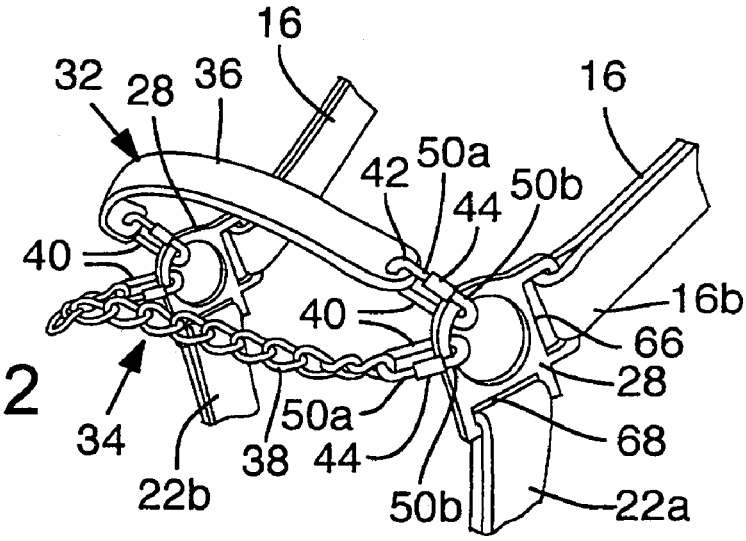
FIG. 2 is an enlarged view of the nose band assembly of the halter illustrated in FIG. 1.

As used herein, the singular forms "a," "an," and "the" refer to one or more than one, unless the context clearly dictates otherwise.

As used herein, the term "includes" means "comprises."

FIG. 1 illustrates a halter 10, according to one embodiment, that generally comprises a set of straps configured to fit securely on a horse's head 12. Halter 10 in the illustrated configuration generally includes a poll strap 14 that extends around the horse's poll, a pair of cheek straps (also referred to herein as connector straps) 16 that extend along the horse's cheeks, a throat strap 18 that extends around the horse's throat latch, a lower jaw strap 20 that extends along the bottom surface of the horse's lower jaw, a chin strap 22 that extends around the bottom of the horse's muzzle, and a nose band assembly 24 that extends around the bridge of the horse's nose. In the illustrated embodiment, the nose band assembly 24 includes a first nose band 32 and a second nose band 34.

As shown, chin strap 22 can comprise first and second chin strap portions 22*a* and 22*b* coupled together via a ring 30 positioned adjacent the bottom surface of the horse's lower jaw. In alternative embodiments, the chin strap can be a unitary strap or any other suitable configuration. Poll strap 14 can include a buckle 52 to adjust the fit of the poll strap around the horse's poll.

In the illustrated embodiment, the ends of poll strap 14 are coupled to adjacent ends of throat strap 18 via first and second rear side rings 26 (also referred to herein as side pieces) positioned on opposite sides of the horse's head. Of course, other types of connections can be employed. The ends of first and second nose bands 32, 34 can be coupled to adjacent ends of chin strap portions 22*a*, 22*b*, e.g., via first and second forward side rings 28 (also referred to herein as forward side pieces) positioned on opposite sides of the horse's head forward side rings 26. Each cheek strap 16 may include a rear end portion 16*a* coupled to a respective rear side ring 26 and a forward end portion 16*b* coupled to a respective forward side ring 28. Forward side rings 26 can be formed with slots, or openings, 66 and 68 dimensioned to receive the forward ends of cheek straps 16 and the upper ends of chin strap portions 22*a*, 22*b* or may be formed in any other suitable fashion. Lower jaw strap 20 is coupled at one end to throat strap 18 and at the opposite end to bottom ring 30.

Bottom ring 30 may also provide a connection point for connecting a lead line 46. Lead line 46 can be coupled to bottom ring 30 with a conventional spring clip 48 or other suitable mechanism. In use, lead line 46 can be tied to a stationary object to limit movement of an unattended horse or is held by a handler when leading the horse.

Poll strap 14, cheek straps 16, throat strap 18, lower jaw strap 20, and chin strap portions 22*a*, 22*b* can be secured to rear side rings 26, forward side rings 28, and bottom ring 30 in any suitable manner. For example, in the illustrated embodiment, rings 26, 28, and 30 extend through small loops that are formed at the end of each strap. Such loops can be formed, e.g., by folding material at the end of a strap back against the strap and then stitching or otherwise securing part of the folded portion to the strap, while leaving a small unstitched area adjacent the fold. In this way, the rings can be secured to the straps without the need for additional fasteners. Lower jaw strap 20 may be secured to throat strap 18 in a similar manner or by other suitable mechanisms. As shown, the rear end portion of lower jaw strap 20 is simply folded over a portion of throat strap 18 and stitched in place. In alternative embodiments, the straps can be secured to one another, e.g., directly, without the use of connectors, such as the illustrated rings 26, 28, and 30.

Poll strap 14, cheek straps 16, throat strap 18, lower jaw strap 20, and chin strap portions 22*a*, 22*b* desirably are constructed of any strong, flexible material. In particular embodiments, for example, the straps comprise one or more layers of a synthetic fabric strap, such as nylon or polypropylene fabric straps. Alternatively, the straps can be constructed from other suitable materials, such as leather and rope. Throat strap 18 can be folded lengthwise, as depicted in FIG. 1, to enhance its fit within the throat latch.

As best shown in FIG. 2, an embodiment of the first nose band 32 may include an elongated elastic portion 36 (also referred to herein as a biasing member) coupled at each end to side rings 28 via respective connecting members 40. Elastic portion 36 can be made of any elastic and/or resilient material. In certain embodiments, elastic portion 36 is made of natural rubber, although any of various other natural or synthetic elastomeric materials also can be used. Elastic portion 36 desirably has a smooth bottom surface engaging the horse's nose so that the horse experiences little or no discomfort from the elastic portion when tension is not applied to the halter.

In certain embodiments, second nose band 34 is formed such that it exhibits little or no elasticity, such as the illustrated metal chain 38. In other embodiments, second nose band 34 can be constructed from non-elastic or substantially non-elastic materials, such as nylon or leather. In the illustrated embodiment, the ends of chain 38 are coupled to side rings 28 via respective connecting members 40 but may also be otherwise connected.

Second nose band 34 may be formed with one or more protuberances or is otherwise irregular in shape so that it will apply concentrated pressure to the horse's nose when tension is applied to the halter via lead line 46. In the illustrated embodiment, for example, the links of chain 38 function to apply concentrated pressure on the horse's nose upon application of tension to the halter. In lieu of chain 38, other nose band configurations can be implemented. For example, the second nose band can comprise a substantially flat strap (e.g., a nylon or leather strap) having a plurality of studs or protuberances that engage the horse's nose. In another implementation, the second nose band can comprise a rope having a plurality of knots or other protuberances formed along its length.

First nose band 32 may be dimensioned to fit snugly around the horse's nose. The second nose band 34 is typically longer than first nose band 32, to fit loosely around the horse's nose when tension is not applied to the halter. As such, second nose band 34 exerts little or no pressure on the horse's nose when tension is not applied to the halter, but increases pressure on the horse's nose upon application of tension. In the embodiment shown in FIG. 1, first nose band 32 is positioned higher on the horse's nose than second nose band 34. In other embodiments, the positions of the nose bands can be reversed or otherwise positioned. For example, second nose band 34 can be positioned higher on the horse's nose than the first nose band 32.

Figure 3:
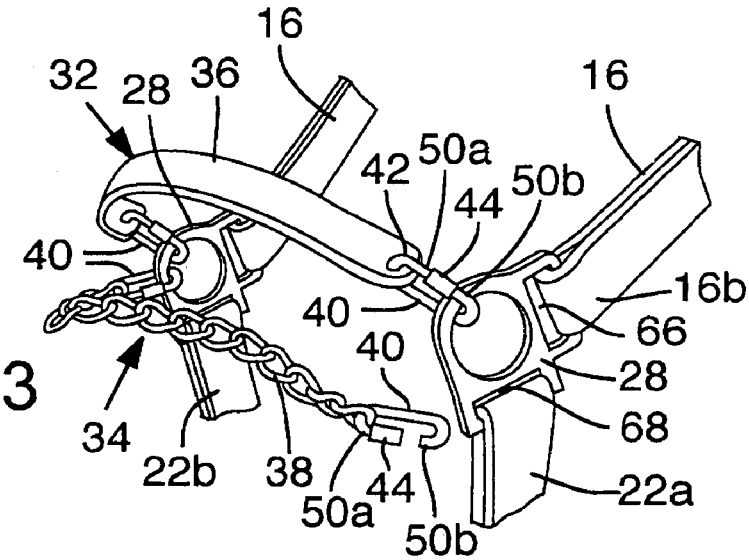
FIG. 3 is an enlarged view of the nose band assembly, in which one end of the chain of the nose band assembly has been disconnected from a respective side ring.

In certain embodiments, the connecting members 40 are configured to permit quick and easy removal of the first and second nose bands from the halter. In the illustrated embodiment, for example, each connecting member 40 comprises a link 42 and an adjustable nut 44. Each link 42 has an opening defined between adjacent end portions 50*a*, 50*b* (FIG. 3) that are received within threaded openings (not shown) of a respective nut 44. As illustrated in FIG. 3, to disconnect the illustrated connecting member 40 from an associated side ring 28, the respective nut 42 is unscrewed from one of the end portions 50*a*, 50*b* so as to open the link 42. When the link is open, it can be removed from its respective side ring 28. Connecting member 40 may comprise other suitable connection devices.

Since in certain embodiments connecting members 40 are removable from side rings 28, one or both nose bands or components thereof can be easily removed and replaced with other nose band or components. For example, general wear and tear may require periodic replacement of elastic portion 36. Alternatively, one or both of the nose bands or components thereof can be replaced to alter the fit and performance of the device. For example, elastic portion 36 can be replaced with elastic straps of greater or lesser elasticity. In addition, chain 38 can be replaced with another type of material so as to vary the intensity of pressure applied to the horse's nose. For example, a rope can be used instead of chain 38 to lessen the intensity of the pressure applied to the horse's nose. In this manner, the halter can be adapted to accommodate the preferences of different handlers or to better suit the horse wearing the halter.

Other types of connecting members also can be used to couple the first and second nose bands to side rings 28 in a removable manner. In one example, a clip mechanism, such as a carabiner, can be used to couple each end of the nose bands to side rings 28. In other embodiments the nose bands can be permanently secured to side rings 28.

FIGS. 4 and 5 show a cross-sectional view and a plan view, respectively, of an embodiment of poll strap 14. Poll strap 14 in the illustrated configuration includes an outer sheath formed from first and second layered straps 54 and 56, respectively, which enclose an inner cord or cable 58. Cable 58 can extend the entire length of poll strap 14 or may extend through a portion of the poll strap (as shown in FIG. 1).

First and second layered straps 54, 56 may form a strong, flexible piece, such as nylon or polypropylene fabric straps. Cable 58 may comprise a strong, flexible member that exhibits little or no elasticity. In certain embodiments, cable 58 comprises a conventional steel cable, such as cable used in bicycle locks. Such a cable typically has a flexible outer covering made of, e.g., a polymeric material such as nylon. In addition, cable 58 can comprise a plurality of smaller diameter cables. Poll strap 14 can be assembled, for example, by placing cable 58 between straps 54, 56 and stitching or otherwise securing the straps together along their longitudinal edges.

As shown in FIG. 4, cable 58 forms a protuberance, or an area of increased thickness along the length of the poll strap. In this manner, cable 58 concentrates the pressure applied to the horse's poll when tension is applied to the halter via lead line 46.

Other portions of halter 10 can have a construction similar to that of poll strap 14. For example, chain 38 can be replaced with a similarly constructed strap for applying pressure to the horse's nose.

Halter 10 illustrated in FIG. 1 is well-suited for leading a horse. When leading a horse, the handler typically walks beside the horse and holds lead line 46. To communicate a signal to the horse, tension is applied to lead line 46, such as by pulling or tugging downwardly on lead line 46, as indicated by arrow A in FIG. 1. Of course, tension is also applied to lead line 46 if the lead line is held steady or tied to a stationary object while the horse pulls away. Upon application of tension, poll strap 14 exerts pressure on the horse's poll and nose band assembly 24 exerts pressure on the horse's nose, signaling the horse to comply with the command.

The illustrated halter 10 is configured to provide the horse with immediate positive feedback after complying with the handler's command. Specifically, as noted above, second nose band 34 fits more loosely on the horse's nose than first nose band 32. Thus, second nose band 34 exerts little or no pressure on the horse's nose when tension is not applied to the halter. However, when pressure is exerted on halter 10 through lead line 46, elastic portion 36 expands and the slack is removed from second nose band 34, causing the second nose band to tighten and apply pressure to the horse's nose. Although elastic portion 36 also applies pressure to the horse's nose, the pressure exerted by second nose band 34 causes greater discomfort due to protuberances or the like (e.g., the links of chain 38) applying concentrated pressure on the horse's nose. Therefore, the discomfort experienced by the horse substantially increases when second nose band 34 is tightened.

When the horse complies with the handler's command (e.g., the horse walks in the direction signaled by the handler), the tension in lead line 46 is removed, which immediately causes elastic portion 36 to contract. The contraction of elastic portion pulls side rings 28 upwardly toward the bridge of the nose, which causes second nose band 34 to loosen and remove pressure from the horse's nose. Hence, the reduction or removal of tension from lead line 46 results in an immediate reduction or removal of the pressure applied to the horse's nose by the second nose band.

The immediate reaction of halter 10 to a reduction of tension on lead line 46 facilitates training a horse to respond properly to control signals from the rider or handler. Like many animals, horses are capable of learning by conditioning. This process can be guided by providing negative reinforcement and positive reinforcement. Tightening or engaging second nose band 34 such that it presses against the horse's nose represents negative reinforcement. In order to associate this negative reinforcement with a particular behavior, the timing of the negative reinforcement must be precisely controlled. Halter 10 regulates the discomfort for the horse so that it becomes meaningful negative reinforcement. When the horse is responding properly to control signals, second nose band 34 rests comfortably on the horse's nose and the horse experiences little or no discomfort. Second nose band 34 causes discomfort to the horse as tension is applied to lead line 46. Since the discomfort is quickly relieved as tension is removed from the lead line, the horse more readily learns how to properly respond to signals from the handler.

The amount of force that must be applied to lead line 46 to cause the second nose band to apply pressure to the horse's nose can be adjusted to suit the particular horse or handler. For example, when training a horse for the first time, it may be desirable to adjust the halter so that less force is required to apply pressure to the horse's nose. On the other hand, when handling a trained horse, it may be desirable to adjust the halter so that more force is required to apply pressure to the horse's nose.

Figure 6:
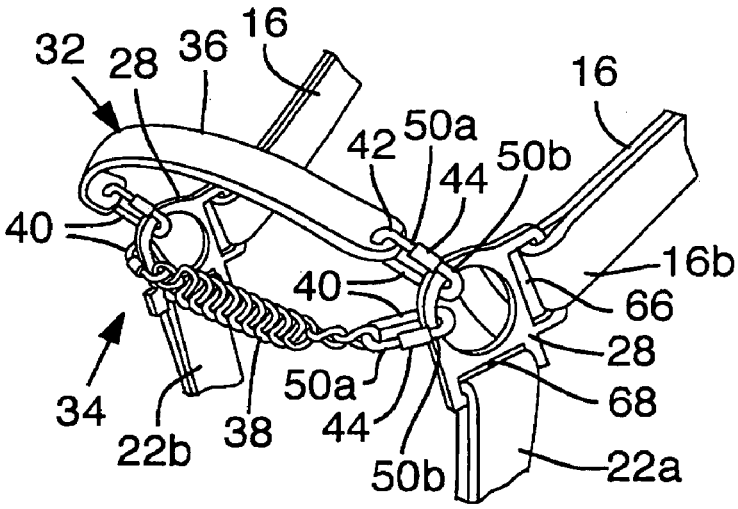
FIG. 6 is an enlarged view of the nose band assembly illustrated in FIG. 1, showing the chain of the nose band assembly after being twisted to decrease its effective length.

One of a myriad of suitable devices or techniques to adjust this force is to change the effective length of second nose band 34. This can be accomplished by disconnecting one or both ends of second nose band 34 from cheek pieces 28, twisting the second nose band so as to decrease its effective length, and reconnecting the second nose band to cheek pieces 28, as depicted in FIG. 6. Alternatively, the effective length of the second nose band can be varied by re-positioning one or both connection members 40 on different links along the length of chain 38. In any event, when the effective length of second nose band 34 is decreased, it fits more tightly on the horse's nose. Therefore, the second nose band engages the horse's nose more quickly and with less force applied to lead line 46. In addition, twisting chain 38 in the manner shown in FIG. 6 causes the links to re-align such that the ends of the links engage the horse's nose. This causes the chain to apply a more aggressive or concentrated pressure to the horse's nose when tension is applied to lead line 46.

Another way to adjust the force required to engage second nose band 34 is to replace elastic portion 36 with another elastic portion with greater or lesser elasticity. Using an elastic portion with greater elasticity will decrease the force required to engage the second nose band. Conversely, using an elastic portion with lesser elasticity will increase the force required to engage the second nose band.

The features described above in connection with halter 10 of FIG. 1 can be implemented in various other embodiments. For example, other parts of a halter can have a configuration similar to nose band assembly 24. In one embodiment, for example, poll strap 14 can be replaced by a first, elastic poll strap and a second, substantially non-elastic poll strap, which operate in a manner similar to nose band assembly 24.

Figure 7:
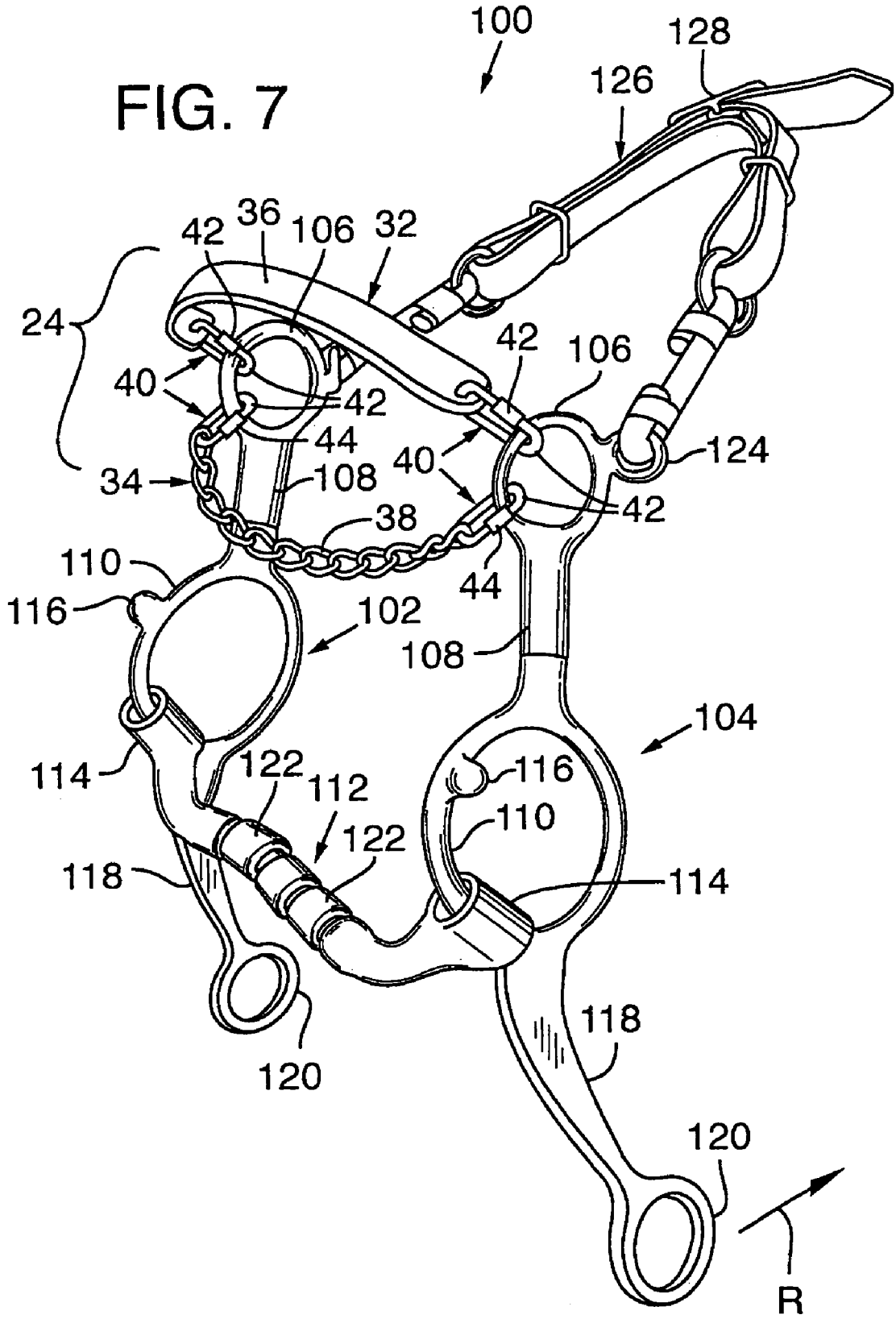
FIG. 7 is a perspective view of a bridle bit, according to one embodiment, incorporating the nose band assembly shown in FIG. 1.

Nose band assembly 24 can also be implemented in other types of horse-control devices. FIG. 7, for example, shows a bridle bit 100, according to one embodiment, that incorporates nose band assembly 24. Unlike halter 10, bridle bit 100 is configured so that the horse can be controlled by a mounted rider.

Bridle bit 100 comprises left and right cheek pieces 102, 104, respectively, which reside closely adjacent the cheeks of a horse (not shown) when bit 100 is connected to a headstall (not shown) and placed on the horse's head. Any headstall can be used with bridle bit 100, for example the headstall may include a poll strap that extends around the horse's poll.

Each cheek piece 102, 104 may include, e.g., a cheek ring 110 coupled to one end of a mouthpiece 112 (or may be connected by other suitable mechanisms). A shank 118 extends downwardly from each cheek ring 110 and terminates at a rein ring 120 for connecting a rein (not shown) of the bridle. A purchase member 108 extends upwardly from each cheek ring 110 and terminates at its upper end in a headstall ring 106 for connecting to a headstall strap of the headstall.

Each cheek ring 110 may include a protruding stop 116, mounted forwardly on each cheek ring and positioned proximate a plane defined by an upper portion of a horse's mouth. Stated differently, a plane defined by the lower limit of the horse's upper jaw as shown. Stops 116 function to limit movement of cheek pieces 102, 104 relative to mouthpiece 114 when the rider is applying tension to the reins.

In particular embodiments, mouthpiece 112 may be sized and shaped to be received in the horse's mouth and have laterally extending opposite outer end portions that may terminate at rings 114. Each mouthpiece ring 114 in the illustrated configuration may be slidably connected to a cheek ring 110 below a respective stop 116 and above a respective shank 118. The mouthpiece 112 may comprise any known type, such as a unitary one-piece mouthpiece, or as another example the jointed mouthpiece shown having two or more interconnected mouthpiece members 122 forming a series of articulated joints.

Each headstall ring 106 can be formed, e.g., with a smaller ring 124, each coupled to one end of an optional curb strap 126 (also referred to as a chin strap) that extends under the horse's chin. Alternatively, the ends of curb strap 126 can be coupled to headstall rings 106 or otherwise be connected, rather than by rings 124. Curb strap 126 can include a buckle 128 to permit adjustment of the effective length of the curb strap. Certain embodiments of the nose band assembly 24 include a first nose band 32 and a second nose band 34 that may be coupled at respective ends to headstall rings 106 via connecting members 40 or by alternative mechanisms.

In use, the rider communicates signals to the horse by applying tension to the reins. When a rider is not applying any rein tension, mouthpiece 122 is slidable relative to the cheek rings 110 and is allowed to float within a horse's mouth. Similarly, no appreciable pressure is applied at the nose, curb or poll of the head. As a rider tightens, or pulls back on, both reins (indicated by arrow R in FIG. 7), an upward pulling force is applied to the lower ends of shanks 118. This tends to rotate cheek pieces 102, 104 roughly about the axes of cheek rings 110, moving headstall rings 106 downward and forward relative to the horse's head.

First nose band 32 and second nose band 34 function in bridle bit 100 much the same way they function in halter 10. Thus, as this rotation occurs, first nose band 32 expands until second nose band 34 tightens and applies increasing downward pressure to the horse's nose. In addition, rotation of cheek pieces 102, 104 also causes mouthpiece 12 to apply increasing downward pressure on the horse's mouth, curb strap 126 to apply increasing upward pressure to the horse's curb, and the poll strap (not shown) to apply increasing downward pressure at the poll. Continued rotation of cheek rings 110 cause stops 116 to engage mouthpiece rings 114, preventing the mouthpiece 112 from sliding over center on the cheek rings and thus releasing mouthpiece pressure.

When rein tension is reduced or removed, first nose band 32 contracts, and therefore pulls the purchase members 108 rearwardly relative to the horse's head. This rearward movement of the purchase members immediately relieves pressure on the horse's nose, mouth, curb and poll.

The disclosed horse-control device has been shown using the described embodiments for illustrative purposes only. The horse-control device may be subject to many modifications and changes without departing from the spirit or essential characteristics thereof. I therefore claim all such modifications as come within the spirit and scope of the following claims.

I claim:

1. A horse-control device comprising:

a first nose band portion for extending over a horse's nose, the first nose band portion being formed of an elastomeric material; and a second nose band portion formed of a non-elastomeric material for extending over the horse's nose, the second nose band portion fitting substantially less tightly on the horse's nose than the first nose band portion such that when tension is applied to the first nose band portion to cause the first nose band portion to stretch, the second nose band portion is caused to apply pressure to the horse's nose.

2. The horse-control device of claim 1, wherein the first nose band portion has a smooth inner surface to engage the horse's nose and the second nose band portion has one or more protuberances that apply pressure to the horse's nose when tension is applied to the first nose band portion.

3. The horse-control device of claim 1, wherein the first and second nose band portions are removable from the device.

4. The horse-control device of claim 1, further comprising a first cheek piece and a second cheek piece, the first and second cheek pieces being positioned on opposite sides of the horse's head, the first and second nose band portions being coupled to and extending between the cheek pieces.

5. The horse-control device of claim 4, wherein the first nose band portion has a first end portion and a second end portion, the first end portion having a first connection member that is coupled to the first cheek piece, the second end portion having a second connection member that is coupled to the second cheek piece.

6. The horse-control device of claim 5, wherein each connection member is connectable to and disconnectable from a respective cheek piece.

7. The horse-control device of claim 4, wherein the second nose band portion has a first end portion and a second end portion, the first end portion having a first connection member that is removably connected to the first cheek piece, the second end portion having a second connection member that is removably connected to the second cheek piece.

8. The horse-control device of claim 4, wherein each of the first and second nose band portions have opposite ends connected to the first and second cheek pieces.

9. The horse-control device of claim 1, wherein the first nose band portion comprises rubber.

10. The horse-control device of claim 1, wherein the second nose band portion comprises a chain.

11. The horse-control device of claim 1, wherein the first nose band portion comprises a rubber strap and the second nose band portion comprises a chain or rope.

12. The horse-control device of claim 1, wherein the first nose band portion is positioned higher on the horse's nose relative to the second nose band portion.

13. The horse-control device of claim 1, wherein the length of the second nose band portion is adjustable to vary the amount of pressure that the second nose band portion applies to the horse's nose.

14. The horse-control device of claim 13, wherein the length of the second nose band portion can be adjusted by changing the configuration of the second nose band portion.

15. The horse-control device of claim 1, further comprising:

an elongated chin strap for extending under the horse's muzzle;

an elongated poll strap for extending across the horse's poll; and first and second, elongated connector straps positioned on opposite sides of the horse's head, each of the connector straps having a rear end portion and a forward end portion, the poll strap being coupled to the rear end portions, while the first nose band portion, the second nose band portion, and the chin strap are coupled to the forward end portions, so as to form a halter.

16. The horse-control device of claim 15, wherein the poll strap comprises a flexible outer covering and a cable enclosed in the outer covering, the cable applying pressure to the horse's poll whenever tension applied to the halter causes the poll strap to bear against the poll.

17. The horse-control device of claim 15, further comprising a lead line connected to the chin strap, wherein application of tension on the lead line causes the first nose band portion to stretch, which in turn causes the second nose band portion to apply pressure to the horse's nose.

18. A horse-control device comprising:

a resilient biasing member formed of an elastomeric material extending over a horse's nose; and a substantially non-resilient nose band formed of a non-elastomeric material extending over the horse's nose;

wherein, when tension is applied to the biasing member, the biasing member stretches across the horse's nose and the nose band engages and applies pressure to the horse's nose, and when tension on the biasing member is removed, the biasing member contracts and the nose band immediately reduces the pressure applied to the horse's nose.

19. The horse-control device of claim 18, wherein the nose band has one or more protuberances that apply concentrated pressure to the horse's nose.

20. The horse-control device of claim 18, further comprising a first cheek piece and a second cheek piece, the first and second cheek pieces being positioned on opposite sides of the horse's head, the biasing member and the nose band being coupled to and extending between the cheek pieces.

21. The horse-control device of claim 18, wherein the nose band comprises a chain having plural interlocking links.

22. The horse-control device of claim 18, wherein the biasing member is shorter in length than the nose band when tension is not applied to the biasing member.

23. The horse-control device of claim 18, wherein the nose band is dimensioned such that it rests loosely on the horse's nose when tension is not applied to the biasing member.

24. The horse-control device of claim 18, wherein the length of the nose band is adjustable to vary the amount of pressure applied to the horse s nose.

25. The horse-control device of claim 18, further comprising a poll strap for extending across the horse's poll, the poll strap being coupled to the biasing member and the nose band, the poll strap comprising an outer sheath and a cable enclosed in the outer sheath, the cable creating a protrusion along the length of the poll strap to apply pressure to the horse's poll when a downward force is applied to the horse control device.

26. A method for controlling a horse comprising applying tension to a first, resilient nose band formed of an elastomeric material extending over the horse's nose, so as to cause a second nose band formed of a non-elastomeric material to apply pressure to the horse's nose.

27. The method of claim 26, further comprising removing tension from the first nose band, so as to cause the second nose band to immediately release pressure on the horse's nose.

* * * * *

UNITED STATES PATENT AND TRADEMARK OFFICE

CERTIFICATE OF CORRECTION

PATENT NO. : 7,124,562 B2
APPLICATION NO. : 10/783400
DATED : October 24, 2006
INVENTOR(S) : Teddie L. Blocker It is certified that error appears in the above-identified patent and that said Letters Patent is hereby corrected as shown below:

Column 10, line 47, “to the horse s nose” should read --to the horse’s nose--.

Signed and Sealed this

Seventh Day of August, 2007

JON W. DUDAS
*Director of the United States Patent and Trademark Office*